US007000284B1

(12) United States Patent
Sowden et al.

(10) Patent No.: US 7,000,284 B1
(45) Date of Patent: Feb. 21, 2006

(54) DRAIN VACUUM ATTACHMENT KIT

(76) Inventors: Ron Sowden, 6635 NE. 12th Ave., Altoona, IA (US) 50009; Andrew Sowden, 6635 NE. 12th Ave., Altoona, IA (US) 50009

( * ) Notice: Subject to any disclaimer, the term of this patent is extended or adjusted under 35 U.S.C. 154(b) by 433 days.

(21) Appl. No.: 10/234,565

(22) Filed: Sep. 4, 2002

(51) Int. Cl.
*A47L 5/00* (2006.01)
*A47L 9/00* (2006.01)

(52) U.S. Cl. ..... 15/314; 15/304; 15/353; 4/255.01; 4/255.05

(58) Field of Classification Search ..... 15/301, 15/304, 310, 314, 341, 353, 405–409; 4/255.01–255.1; 285/7
See application file for complete search history.

(56) References Cited

U.S. PATENT DOCUMENTS 2,300,319 A * 10/1942 Smith ..... 4/255.01
2,326,439 A * 8/1943 Clements ..... 285/7
4,674,137 A * 6/1987 Girse ..... 4/255.03
4,676,265 A 6/1987 Volk
4,712,575 A 12/1987 Lair et al.
4,933,017 A * 6/1990 Brzoska ..... 134/21
5,085,244 A 2/1992 Funk
D361,371 S 8/1995 McQuillan
5,524,296 A * 6/1996 Leighton ..... 4/255.05
5,530,988 A 7/1996 McQuillan
5,664,284 A * 9/1997 Brzoska ..... 15/330
D404,178 S 1/1999 Wetzler
5,996,597 A 12/1999 Gallo
6,098,212 A 8/2000 Rogan
2003/0226229 A1 * 12/2003 Bryant ..... 15/304

* cited by examiner

*Primary Examiner*—Terrence R. Till
(74) *Attorney, Agent, or Firm*—John D. Gugliotta

(57) ABSTRACT

An apparatus is provided to aid in the removal of blockages from sanitary waste lines on sinks, showers and the like. Two pieces of flexible hose connect to a standard utility vacuum. The first piece of hose, approximately six to eight feet long, connects to the suction port of the vacuum. The second piece of hose, approximately 20 feet long, connects to the exhaust port of the vacuum. A special drain adapter connects to the other end of the suction hose. The adapter, with a small diameter piece of plastic pipe, and a flexible shroud which is similar in nature to a rubber plunger, forms an air tight seal between the suction hose and the drain.

6 Claims, 5 Drawing Sheets

DRAIN VACUUM ATTACHMENT KIT

RELATED APPLICATIONS

The present invention was first described in Disclosure Document Registration 503,658 filed Jan. 11, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to drain suction and cleanout device and, more particularly, to a kit you have disclosed to allow a conventional shop-type vacuum to be adapted for vacuum or ventilation of a drainage system.

2. Description of the Related Art

There is no other plumbing task more appalling than having to deal with a clogged sink, shower or similar drain. As even the most skilled plumber will attest, unclogging a drain line can be extremely difficult in some situations. The plumber will usually try a conventional plunger at first to dislodge the blockage. If the standard plunger does not work, the plumber is forced to resort to using an auger or a powered snake or even the disassembly of the drain trap. The use of these tactics increases the possibility of a greater mess in one's home, as well as the time required for the repair. This in turn results in greater cost for the plumber which is in turn passed along to the homeowner much to their displeasure.

A search of the prior art did not disclose any patents that read directly on the claims of the instant invention; however, the following references were considered related.

U.S. Pat. No. 5,085,244 issued in the name of Funk, describes an assembly for cleaning a drain conduit.

U.S. Pat. No. 4,712,575 issued in the name of Lair et al., describes a self-draining hose connection vacuum breaker and backflow preventer.

U.S. Pat. No. 4,676,265 issued in the name of Volk, describes a vacuum pump drain device for draining contaminating water from the oil reservoir of a vacuum pump.

U.S. Pat. No. 5,530,988 issued in the name of McQuillan, describes a device for unclogging pipes or other lines.

U.S. Pat. No. 6,098,212 issued in the name of Rogan, describes a kit for forming a plumbing apparatus for aiding in the soaking of drainpipes.

U.S. Pat. No. 5,996,597 issued in the name of Gallo, describes a readily transportable compact, and self-contained drain cleaning apparatus.

U.S. Pat. No. D404, 178 issued in the name of Wetzler, is an ornamental design for a combined toilet plunger and multi-purpose drain opener.

U.S. Pat. No. D361, 371 issued in the name of McQuillan, is an ornamental design for a pressure-cleaning device for cleaning conduits.

Consequently, there exists a need for a means by which clogs or blockages in drain systems which cannot be dislodged by a conventional plunger can be removed without resorting to more labor intensive repair processes.

SUMMARY OF THE INVENTION

It is therefore an object of the present invention to provide an improved to drain suction and cleanout device.

It is a feature of the present invention to provide an improved kit to allow a conventional shop-type vacuum to be adapted for vacuum or ventilation of a drainage system.

Briefly described according to one embodiment of the present invention, an apparatus is provided to aid in the removal of blockages from sanitary waste lines on sinks, showers and the like. The invention consists of two pieces of flexible hose which connects to a standard utility vacuum. The first piece of hose, approximately six to eight feet long, connects to the suction port of the vacuum. The second piece of hose, approximately 20 feet long, connects to the exhaust port of the vacuum. A special drain adapter connects to the other end of the suction hose. The adapter, with a small diameter piece of plastic pipe, and a flexible shroud which is similar in nature to a rubber plunger, forms an air tight seal between the suction hose and the drain. To use the invention, the user simply places the suction hose, with the drain adapter attached, in the clogged drain. The exhaust hose is then routed to an outside location for the discharge of any obnoxious drain odors. When the vacuum is activated, the clog is simply sucked out of the drain with no mess or fuss.

The use of the Drain Vacuum Attachment Kit results in the quick dislodging of any blockages in sanitary waste lines in a safe and effective manner with minimal mess and fuss.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

1. Detailed Description of the Figures

Figure 1:
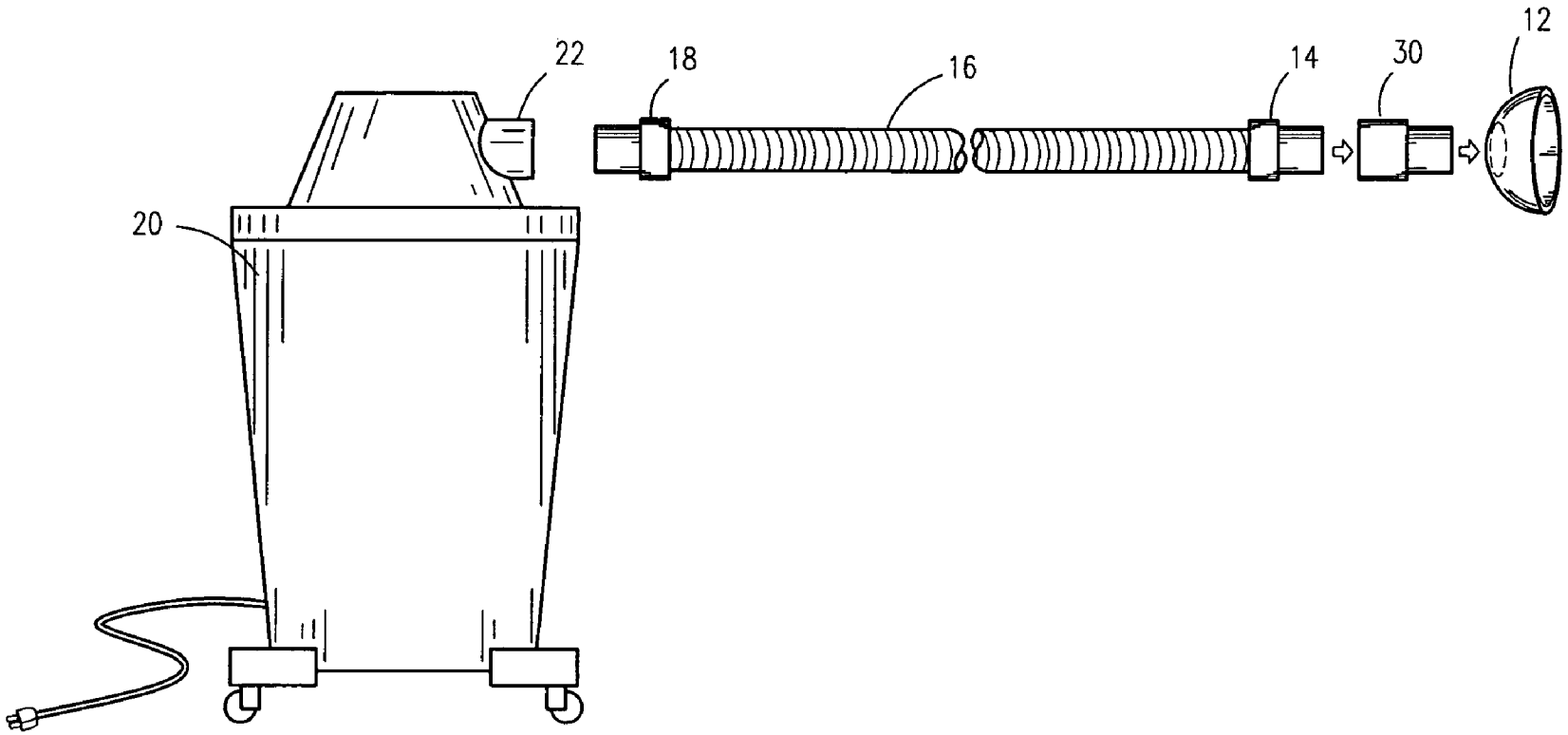
FIG. 1 is a block diagram of a vacuum drainage system.

Referring now to FIG. 1, a vacuum drainage system 10 is shown, in accordance with the present invention, and includes a vacuum cap 12 coupled to an end portion 14 of a flexible conduit means 16 and with an opposing end portion 18 coupled to a standard industrial vacuum 20, such as a SHOP-VAC™, at a suction neck 22.

Figure 2:
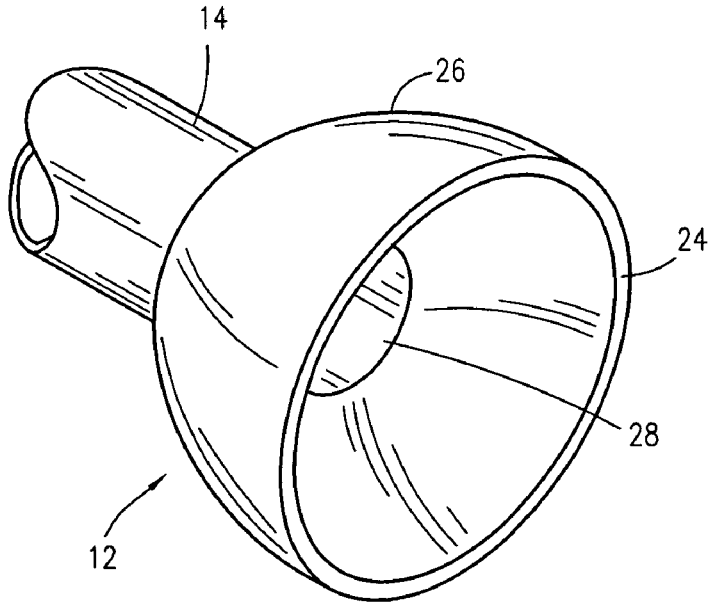
FIG. 2 is an elevated perspective of a vacuum cap receiving one end of a flexible hose.
Figure 3:
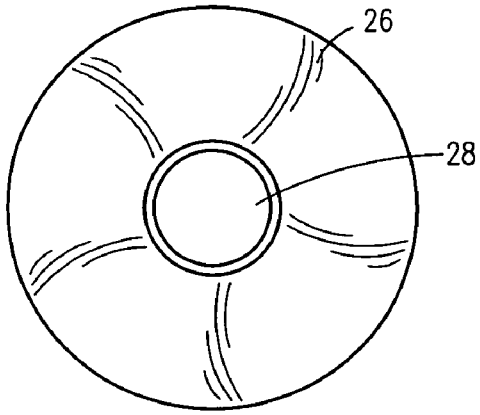
FIG. 3 is a top view of the apparatus of FIG. 2.
Figure 4:
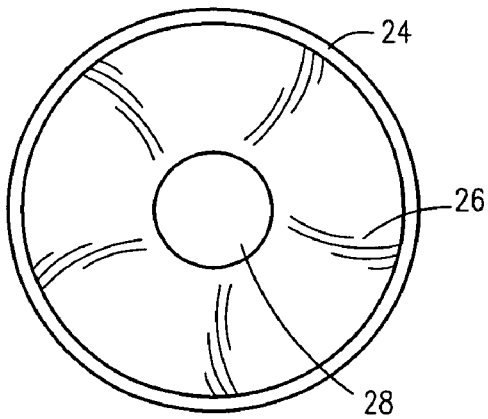
FIG. 4 is a bottom view of the apparatus of FIG. 2.

Referring now to FIG. 2, FIG. 3 and FIG. 4, a vacuum cap 12 is shown and includes a circular base ring 24 depending from a concave dome 26 with an aperture 28 formed in the top center of the dome 26. The aperture 28 slidably receives the end portion 14 of the conduit means 16, forming a vacuum-sealed means for extracting debris clogging a pipe. Preferably, the vacuum cap 12 is manufactured from rubber or other similar substance sufficiently flexible to form a vacuum-seal, yet sufficiently rigid to withstand the reverse air pressure exerted upon the vacuum cap 12 by the industrial vacuum 20.

Figure 5:
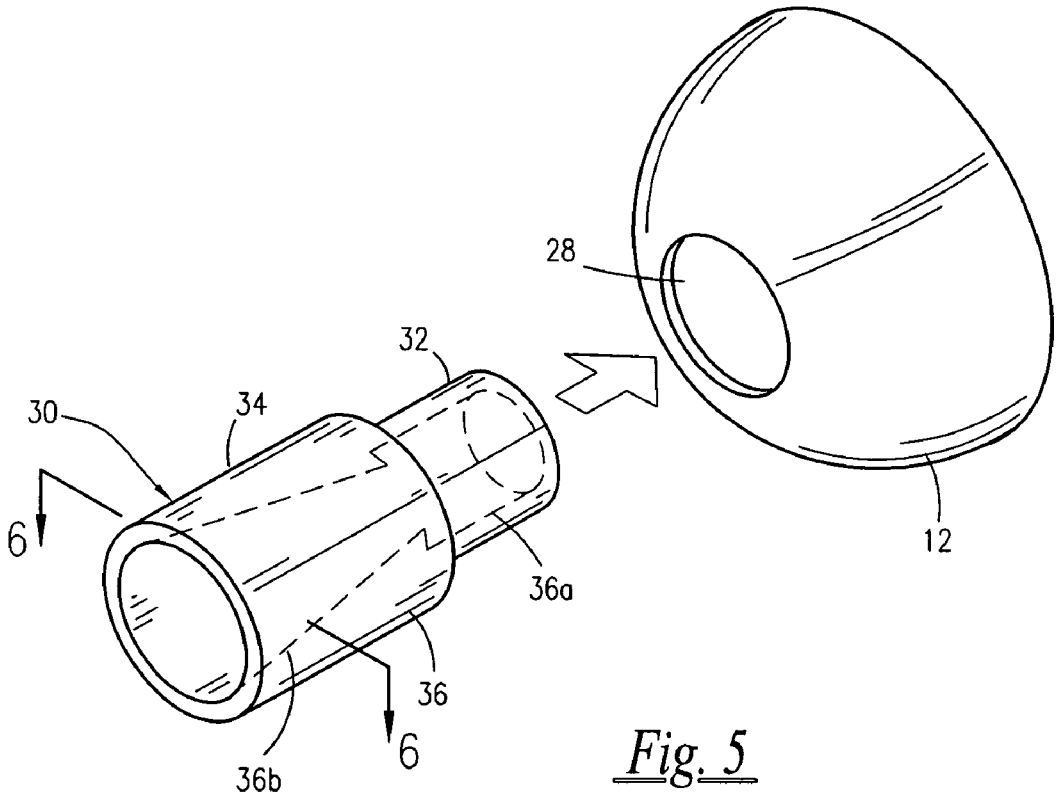
FIG. 5 is an exploded perspective of an optional aperture adapter.
Figure 6:
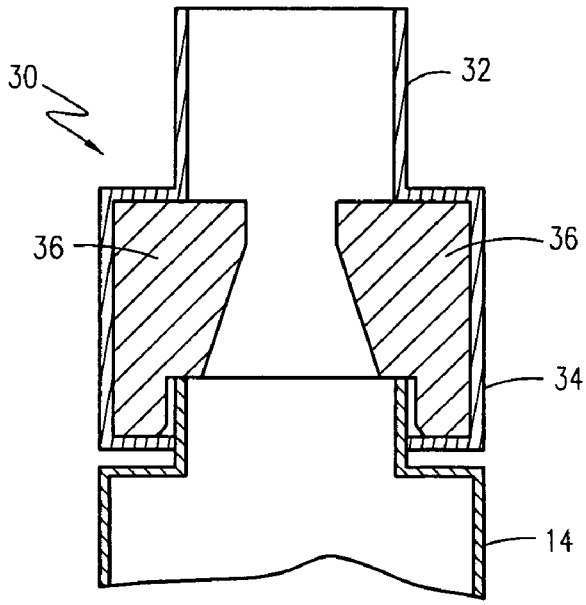
FIG. 6 is a cross-sectional view of the apparatus of FIG. 5, taken through line 6—6, illustrating the connectivity of the end portion to the inner skirt of the aperture adapter.

Referring now to FIG. 5 and FIG. 6, if the end portion 14 of the conduit means 16 and the aperture 28 are incompatible in size, the end portion 14 is slidably inserted into an optional aperture adapter 30, and the aperture adapter 30 is then slidably inserted into the aperture 28, forming a vacuum-sealed means for extracting debris clogging a pipe. The aperture adapter 30 includes a narrowed head 32 depending from a rigidly cylindrical adapter shaft 34. The narrowed head 32 slidably and securely inserts into the aperture 28. The adapter shaft 34 houses a flexible conically tapered inner skirt 36, with a small conical opening 36*a* and an opposable large conical opening 36*b*, in which the small conical opening 36*a* adjacent to the narrowed head 32. The conically tapered inner skirt 36 is capable of receiving and securely holding the end portion 14 of the conduit means 16. Preferably, the inner skirt 36 is manufactured from a pliable plastic material so that the skirt may sufficiently expand or retract according to the size of the end portion 14 to be inserted.

Figure 7:
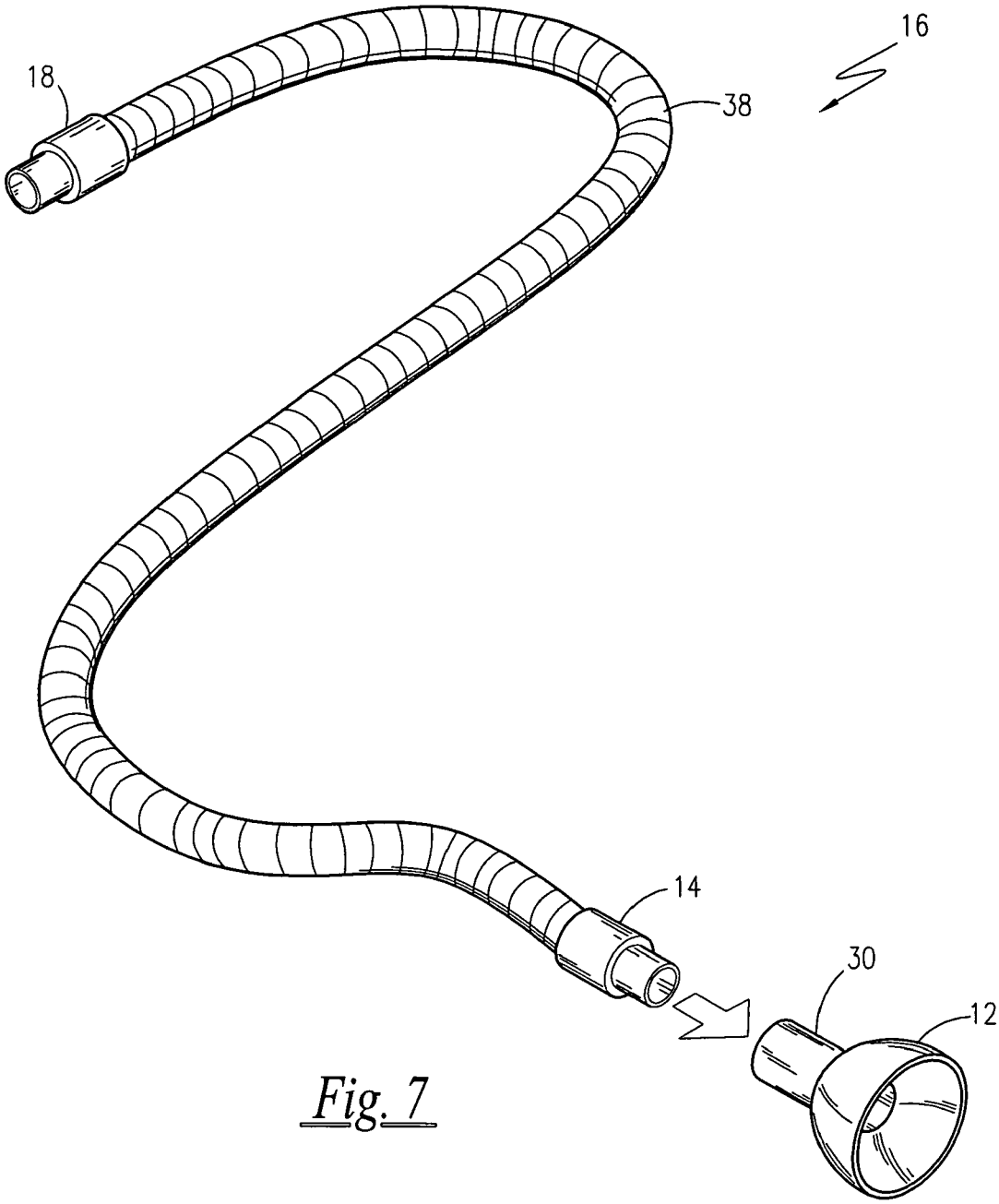
FIG. 7 is a perspective view of a flexible hose and its attendant components.

Referring now to FIG. 7, a flexible conduit means 16 is shown and includes two similarly formed end portions 14 and 18, respectively, and connected by a flexible shaft portion 38. The end portions 14 and 18 are of a rigidly cylindrical form and depend from the flexible shaft portion 38. The rigidly cylindrical form provides the structural integrity to the end portions 14 and 18 so as to provide a secure connectivity to either the suction mouth 22 of the industrial vacuum 20, the aperture 28, or the aperture adapter 30. Preferably, the end portions 14 and 18 are comparatively more rigid than the flexible shaft portion 38. The flexible shaft portion 38 should be of a flexibility demonstrated in standard corrugated and extendable vacuum attachments, such as an attachment hose capable of expansion to reach difficult heights, for example.

Figure 8:
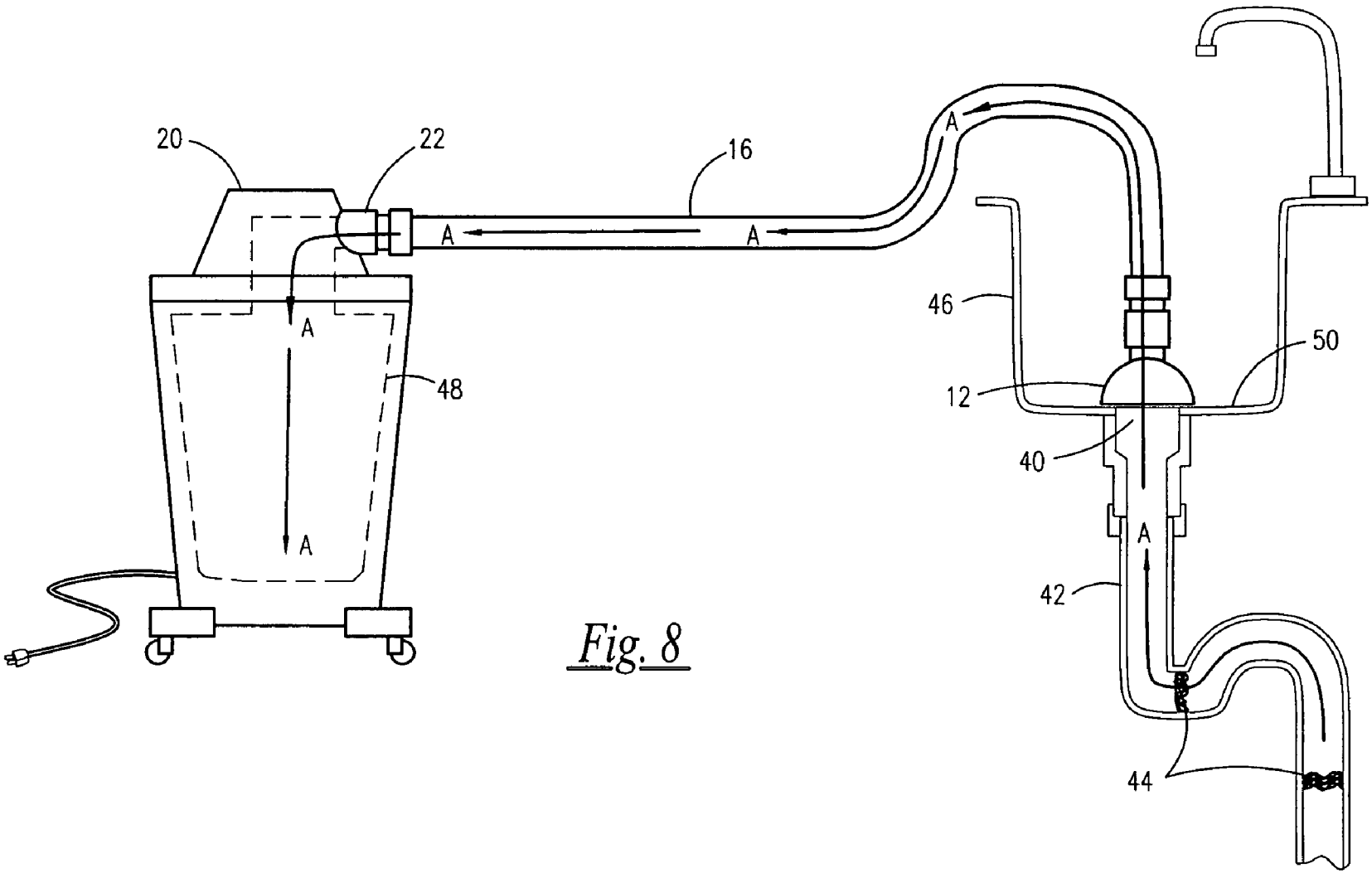
FIG. 8 is a block diagram of a vacuum drainage system illustrating the connection and operation of the system in relation to a blocked plumbing line.

Referring now to FIG. 8, the vacuum drainage system 10 is shown in a completely connected and usable arrangement. The opposing end portion 18 of the flexible conduit means 16 is slidably coupled to the suction mouth 22 of the industrial vacuum 20. The end portion 14 of the flexible conduit means 16 is slidably coupled to the aperture 28 of the vacuum cap 12. The vacuum cap 12 is securely sealed over the sink drain opening 40, forming a vacuum seal suitable for evacuating the debris 44 that is clogging the pipe or plumbing 42. If the vacuum seal is properly formed, the industrial vacuum 20 can suction the debris 44 along the general direction A through the plumbing 42, the flexible conduit means 16 and into the debris collection area 48 of the industrial vacuum 20.

2. Operation of the Preferred Embodiment

A user will assemble the vacuum drainage system 10 by slidably coupling the opposing end portion 18 into the suction mouth 22 of the industrial vacuum 20. The user will then slidably couple the end portion 14 into the aperture 28 of the vacuum cap 12. If the end portion 14 and the aperture 28 are of incompatible sizes, the end portion 14 is slidably inserted into the aperture adapter 30 until the end portion 14 securely abuts against the inner skirt 36 to form a seal between the end portion 14 and the aperture adapter 30. The aperture adapter 30 is slidably coupled into the aperture 28. The vacuum cap 12 is placed over the drain opening 40, with the user making sure to form a vacuum-seal between the circular base ring 24 of the vacuum cap 12 and the sink basin 50, in a manner similar to adhering a suction cup to any surface. Once the vacuum-seal is formed, the industrial vacuum 20 is turned "on" to activate suction. The suction will forcibly pull the debris 44 through the plumbing 42, into the flexible conduit means 16 and into the debris collection area 48 of the industrial vacuum 20, with the general direction of this suction force illustrated as direction A.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

The invention claimed is:

1. A vacuum drainage system comprising:

a vacuum cap coupled to an end portion, said cap having an aperture;

flexible conduit means with an opposing end portion;

a standard industrial vacuum having a suction neck; and an aperture adapter slidably inserted into said aperture for forming a vacuum-sealed means for extracting debris clogging a pipe, wherein said aperture adapter includes a narrowed head depending from a rigidly cylindrical adapter shaft such that said narrowed head slidably and securely inserts into the aperture.

2. The vacuum drainage system of claim 1, wherein said adapter shaft houses a flexible conically tapered inner skit with a small conical opening and an opposable large conical opening in which the small conical opening adjacent to the narrowed head, such that the conically tapered inner skirt is capable of receiving and securely holding the end portion of the conduit means.

3. The vacuum drainage system of claim 2, wherein said inner skirt is manufactured from a pliable plastic material so that the skirt may sufficiently expand or retract according to the size of the end portion to be inserted.

4. The vacuum drainage system of claim 1, further comprising:

a vacuum cap coupled to an end portion;

flexible conduit means with an opposing end portion, wherein said flexible conduit means includes two similarly formed end portions connected by a flexible shaft portion, said end portions are of a rigidly cylindrical form and depend from the flexible shaft portion; and a standard industrial vacuum having a suction neck.

5. The vacuum drainage system of claim 1, wherein said vacuum cap includes a circular base ring depending from a concave dome with an aperture formed in the top center of the dome, wherein said aperture slidably receives said end portion of said conduit means such as to form a vacuum-sealed means for extracting debris clogging a pipe.

6. The vacuum drainage system of claim 1, wherein said vacuum cap is sufficiently flexible to form a vacuum-seal, yet sufficiently rigid to withstand the reverse air pressure exerted upon the vacuum cap by the industrial vacuum.

* * * * *